United States Patent [19]

Coleman

[11] 4,205,471

[45] Jun. 3, 1980

[54] DOUBLE FACED SIGN WITH PERIMETER MOUNTING FLANGES

[76] Inventor: Kelly R. Coleman, 1910 Saddle Hill Rd. South, Dunedin, Fla. 33528

[21] Appl. No.: 854,251

[22] Filed: Nov. 23, 1977

[51] Int. Cl.[2] ..... G09F 7/18; G09F 13/04

[52] U.S. Cl. ..... 40/572; 40/152.1; 40/549; 40/607; 248/466

[58] Field of Search ..... 40/572, 574, 607, 605, 40/578, 564, 155, 152.1, 152.2, 549; 220/84 R, 80, 3.9; 52/656; 403/401–403; 248/466, 473

[56] References Cited

U.S. PATENT DOCUMENTS

| | | | |
|---|---|---|---|
| 2,791,851 | 5/1957 | Richter | 40/572 |
| 3,235,989 | 2/1966 | Brooks | 40/549 |
| 3,378,977 | 4/1968 | Vervloet | 52/656 X |
| 3,528,692 | 9/1970 | De Vries | 52/656 X |
| 3,955,298 | 5/1976 | Kapstad | 40/152 |

OTHER PUBLICATIONS

ADCO Dealer Handbook, ADCO Sign Corp. 1974, p. 51, Space Frames.

*Primary Examiner*—John F. Pitrelli

*Attorney, Agent, or Firm*—Cushman, Darby & Cushman

[57] ABSTRACT

An illuminated display means is shown having, in combination, a support and a double faced sign frame. The structure includes a support having rigid arms for holding the sign frame in a generally vertical position for display of both of the faces thereof. The sign frame is formed of an extruded aluminum strip that is shaped to have protruding flange means adapted to slide into engagement with rigid arms on the support to permit easy and quick assembly of the sign frame on its support means. Preferably, a vertical support post is provided having the rigid arms extending horizontally therefrom on both sides of the post to provide a balanced multiple sign display.

5 Claims, 3 Drawing Figures

Fig. 1
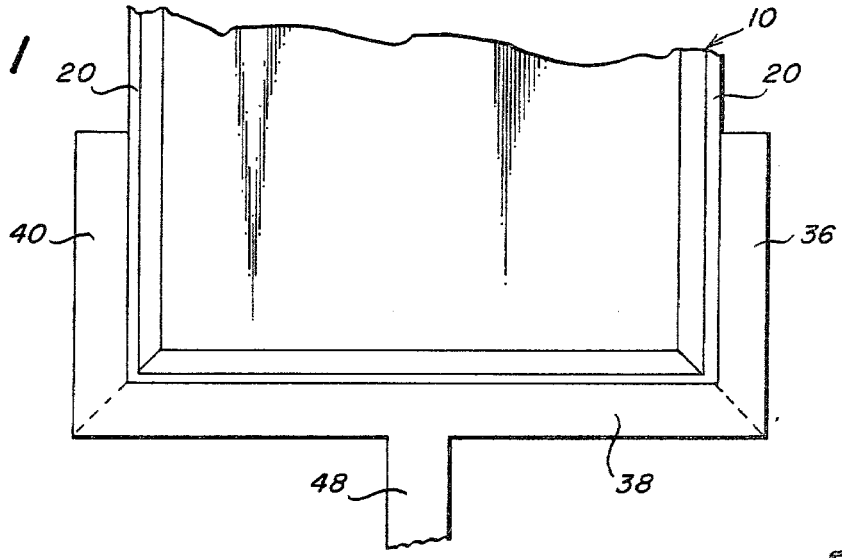
Fig. 2
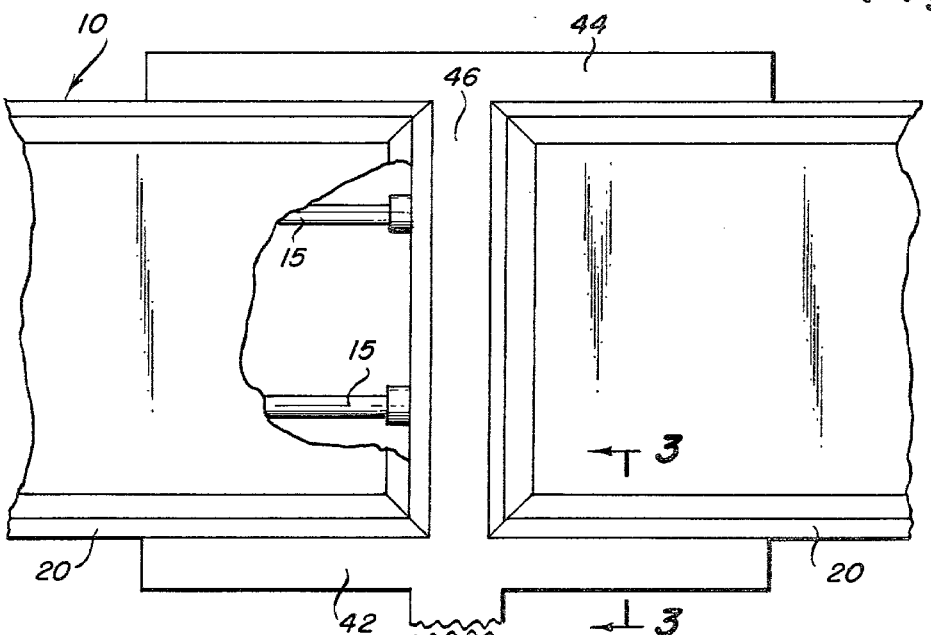
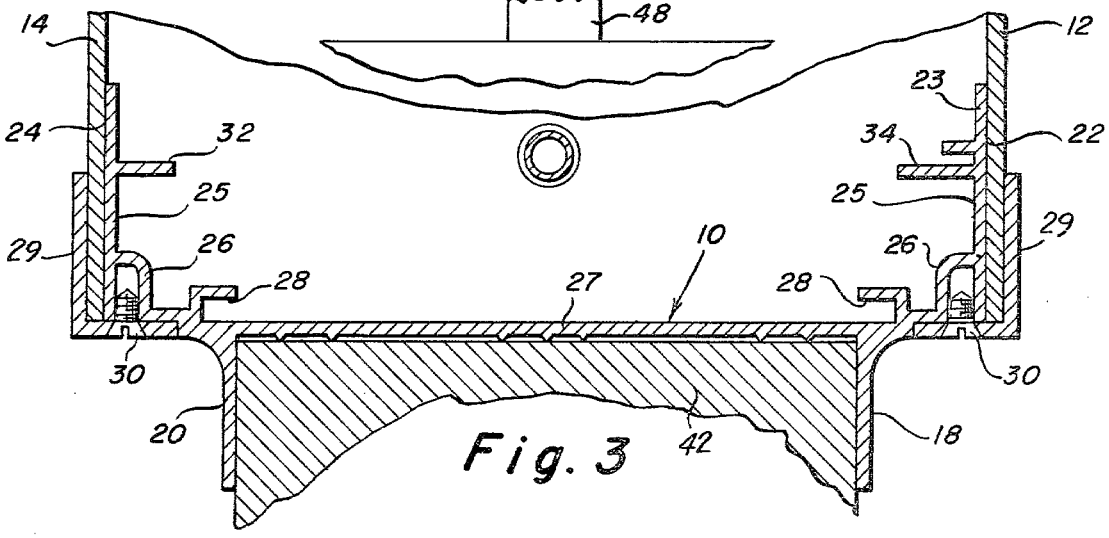
Fig. 3

DOUBLE FACED SIGN WITH PERIMETER MOUNTING FLANGES

BACKGROUND

It is known in the art to provide signs having displays on two vertically arranged faces as illustrated in the U.S. Pat. No. 900,590, to Raymond, Oct. 6, 1908 and to Ressel, 2,940,198, June 14, 1960. These typical examples of signs and their support means illustrate the more complex structures heretofore used for this purpose.

BRIEF DESCRIPTION OF THIS INVENTION

The structure here shown provides a simple unitary frame structure made by assembling extruded aluminum rod elements to produce frames having integral protruding flanges adapted to cooperate with the supports. The support means for the double faced sign here shown, includes rigid horizontally disposed arm means for slidably receiving the flange means that protrude from the frame so that with a simple assembly operation, the sign structure can be mounted on its support.

The protruding flange engaging means integral with the frame can be shaped to be supported on any rigid member over which the flange means can slide. As here shown, preferably a vertically arranged post has a plurality of integral rigid arm support means extending horizontally therefrom on the opposite sides of the post so that a pair of double faced sign frames can be supported in a balanced relationship on the one support post to display a plurality of messages to those approaching the sign from opposite directions.

The frame may be provided with lighting means either supported externally on the post support or disposed internally within the sign frame to illuminate translucent covers or other messages displayed on the oppositely disposed faces.

It is a principal object of this invention to provide a simplified sign structure and mounting means therefor.

Another object of the invention is to provide a simplified but secure mounting means for receiving a double faced sign for display.

Another object of the invention is to provide a sign and support means that permit simple assembly and removal of the sign from the support so that the sign display can be easily changed.

These and other objects will appear more fully in the more detailed description below.

IN THE DRAWINGS

FIG. 1 is a front elevation showing a single double faced sign of this invention carried in a support at the top of a post;

FIG. 2 is a front elevation, partly broken away, showing two double faced signs carried on a single support post; and FIG. 3 is a cross-sectional view of the shape of the aluminum extruded rod used for making the frame of the double faced sign, taken on line 3—3 of FIG. 2.

DETAILED DESCRIPTION

The sign frame of this invention is formed with a pair of integral protruding flanges adapted to form a channel means that surrounds the periphery of the sign. The channel means is designed to cooperate with the support means by telescopically sliding over rigid support arms for the sign. For this purpose, the sign frame 10 is formed as a unitary structure from extruded aluminum rod means shaped as shown in FIG. 3. Four lengths of the rod may be cut to length and mitered to be fitted together and are welded at the corners to form a preferably rectangular frame to provide the desired rigid frame.

The frame is adapted to be carried in suitable support means with the opposite faces of 12 and 14, see FIG. 3, disposed substantially vertically to provide a double faced display. The faces 12 and 14 may be formed of any suitable display supporting means and preferably translucent cover means are provided for each face. The sign is designed in its preferred form, to be lighted with elongated lamp means 15 disposed within the frame to illuminate the signs or an external light means could be provided for lighting the display. Either a self-contained lighting means and source of current may be provided, but where convenient, an electrical current may be connected between an outside source and light means supported within the frame for the sign.

The rigid rectangular frame 10 has integral flange means 18 and 20 protruding from its periphery to provide spaced apart parallel walls that form a channel extending around all sides of the frame for the sign. The side faces 22 and 24 of the frame are defined by the outside faces of the inturned flanges 23 and 25 integral with web 27 that constitutes the main perimeter element of the frame, the flanges extend inwardly from the periphery of the frame at a right angle to the web.

As shown in FIG. 3, the inturned flanges 23 and 25 are joined to the web 27 by two pairs of U-shaped stiffening channel elements 26 and 28, the open ends of which face at right angles with respect to each other to rigidify the frame in two dimensional directions at each corner. The display carrying covers 12 and 14 are held against faces 22 and 24 by picture frame means 29 fitted over the covers and over the edges of web 27. The open end of channels 26 face outwardly around the periphery of the frame 10 near the edges of web 27 and additionally serve to receive self-tapping screw means 30 used to mount the picture frame means on the sign frame to secure the covers 12 and 14 on the faces 22 and 24. Additional stiffening flange elements 32 and 34 exposed to the interior of the frame can be provided if deemed necessary.

The inside faces of the protruding flange elements 18 and 20 are spaced apart a sufficient distance to have a sliding fit over suitable support arms 36, 38 and 40 as shown in FIG. 1 or, as shown in FIG. 2, to partially surround and slide onto arms 42 and 44 and to engage over the side edges of the vertical support post 46. It will be seen in FIG. 3 that flanges 18 and 20 engage snugly onto arm 42, for example, so that when the frame is slid onto its supporting arms with flanges 18 and 20, engaged on arms 36, 38 and 40, the frame is rigidly fixed on three sides. If needed, a latching means may be provided to hold the frames on their support arms, but in general practice, the fit of flanges 18 and 20 onto their respective supports can be made tight enough to preclude any accidental displacement of the double faced sign frames from their supports.

As shown in FIG. 1, a roughly Y-shaped support means, including post 48 and integral arms 36, 38 and 40, is designed to support a double faced sign display slid vertically into its support means.

In FIG. 2, the vertical post 48 has integral arms 42 and 44 mounted crosswise thereon to extend horizontally from the opposite sides thereof. With this construction, a balanced design is provided to support two double faced sign displays.

The above description covers the preferred structure and manner of using the double faced sign structure of this invention, but modifications thereof may occur to those skilled in the art that will fall within the scope of the following claims.

I claim:

1. A double faced sign comprising a closed perimeter frame having two spaced-apart, parallel, straight sections; two opposed, spaced-apart generally coextensive display faces supported along their edges by the perimeter frame; a stationary mounting flange structure permanently fixed to said frame, said mounting flange structure having side walls projecting outwardly from each of said straight sections in the plane of said frame; and support means for supporting said sign in a vertical position, said support means including two fixed, spaced-apart parallel arms each of which is in slidable engagement with the side walls of one of said straight sections whereby said frame is mounted and demounted by being slid into and out of said support means.

2. A sign as in claim 1 wherein said mounting flange structure includes two spaced apart parallel webs, said side walls being constituted by the surfaces of said webs which face each other.

3. A sign as in claim 2 wherein said frame is rectangular, wherein said mounting flange and side walls extend completely around the periphery of said frame and wherein said support means includes a third arm extending transversely to and connected to said two arms, said third arm engaging the side walls which project from the corresponding edge of said frame when said frame is slid into said support means.

4. A sign as in claim 3 including illuminating means within said frame for back-lighting said display faces, said display faces being translucent.

5. A sign as in claim 3 wherein said support means includes a vertical post having a lower end for setting into the ground and having an upper end connected to said arms.

* * * * *